US010480294B2

(12) United States Patent
Duncan

(10) Patent No.: US 10,480,294 B2
(45) Date of Patent: Nov. 19, 2019

(54) METHODS FOR PRESERVING ZONAL ISOLATION WITHIN A SUBTERRANEAN FORMATION

(71) Applicant: Suncor Energy Inc., Calgary (CA)

(72) Inventor: Grant Duncan, Calgary (CA)

(73) Assignee: Suncor Energy Inc., Calgary (CA)

( * ) Notice: Subject to any disclaimer, the term of this patent is extended or adjusted under 35 U.S.C. 154(b) by 84 days.

(21) Appl. No.: 15/117,160

(22) PCT Filed: Feb. 3, 2015

(86) PCT No.: PCT/CA2015/000060
§ 371 (c)(1),
(2) Date: Aug. 5, 2016

(87) PCT Pub. No.: WO2015/117223
PCT Pub. Date: Aug. 13, 2015

(65) Prior Publication Data

US 2016/0356130 A1 Dec. 8, 2016

(30) Foreign Application Priority Data

Feb. 7, 2014 (CA) ..... 2842406

(51) Int. Cl.
*E21B 43/10* (2006.01)
*E21B 29/10* (2006.01)
(Continued)

(52) U.S. Cl.
CPC ..... *E21B 43/103* (2013.01); *E21B 29/10* (2013.01); *E21B 33/12* (2013.01); *E21B 33/14* (2013.01); *E21B 43/105* (2013.01)

(58) Field of Classification Search
CPC ..... E21B 43/103; E21B 43/105; E21B 29/10; E21B 33/12
(Continued)

(56) References Cited

U.S. PATENT DOCUMENTS 4,780,266 A * 10/1988 Jordan ..... E21B 47/1015 166/250.17
5,775,803 A * 7/1998 Montgomery ..... G05D 21/02 366/152.2
(Continued)

FOREIGN PATENT DOCUMENTS

CA 2130957 C 12/1997
CA 2425335 A1 10/2003
(Continued)

OTHER PUBLICATIONS

Canadian Office Action dated Dec. 30, 2015 for Canadian Patent Application No. 2,842,406.
(Continued)

*Primary Examiner* — Taras P Bemko
(74) *Attorney, Agent, or Firm* — McCarthy Tétrault LLP

(57) ABSTRACT

There is provided a method for effecting at least partial interference of a fluid passage extending between a casing, disposed within a wellbore that is penetrating a subterranean formation, and the subterranean formation. The method includes detecting the fluid passage, and effecting an operative displacement of a casing section of the casing such that at least partial interference of the fluid passage is effected.

31 Claims, 11 Drawing Sheets

(51) Int. Cl.
*E21B 33/12* (2006.01)
*E21B 33/14* (2006.01)

(58) Field of Classification Search
USPC ..... 166/386
See application file for complete search history.

(56) References Cited

U.S. PATENT DOCUMENTS

| | | | | |
|---|---|---|---|---|
| 7,228,915 | B2 | 6/2007 | Thomson | |
| 8,230,913 | B2 | 7/2012 | Hart et al. | |
| 8,392,158 | B2 | 3/2013 | James | |
| 2005/0023000 | A1 | 2/2005 | Warren et al. | |
| 2008/0257605 | A1* | 10/2008 | Hewson | E21B 7/061 175/65 |
| 2008/0302543 | A1 | 12/2008 | O'Connor et al. | |
| 2010/0038076 | A1 | 2/2010 | Spray et al. | |
| 2010/0147535 | A1* | 6/2010 | Gorrara | E21B 43/103 166/382 |
| 2012/0018154 | A1* | 1/2012 | James | C09K 8/42 166/293 |

FOREIGN PATENT DOCUMENTS

| | | | |
|---|---|---|---|
| CA | 2596245 | A1 | 7/2006 |
| CA | 2465933 | C | 7/2008 |
| CA | 2479960 | C | 1/2009 |
| CA | 2771698 | A1 | 3/2011 |
| CA | 2523106 | C | 12/2011 |
| CA | 2667347 | C | 3/2012 |
| CA | 2467381 | C | 1/2013 |
| GB | 2382361 | A | 5/2003 |

OTHER PUBLICATIONS

International Search Report dated May 4, 2015 for International Application No. PCT/CA2015/000060.
Written Opinion of the International Search Authority dated May 4, 2015 for International Application No. PCT/CA2015/000060.
Saidin, S. et al., A New Approach for Optimizing Cement Design to Eliminate Microannulus in Steam Injection Wells, IPTC 12407, pp. 1-15 (2008).
Rusch, D. W. et al., Microannulus Leaks Repaired with Pressure-Activated Sealant, SPE 91399, pp. 1-7 (2004).
Supplementary Partial European Search Report dated Dec. 20, 2017 for European Patent Application No. 15746758.0.

* cited by examiner

FIG. 3A
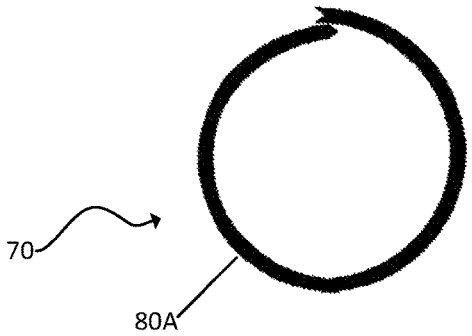
FIG. 3B
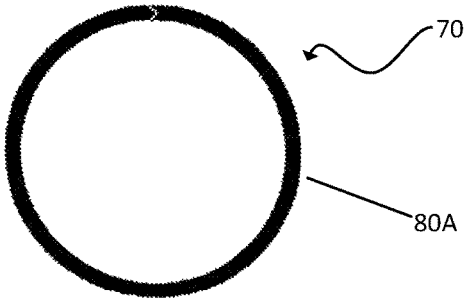
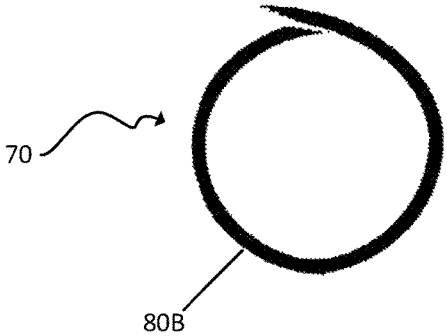
FIG. 4A
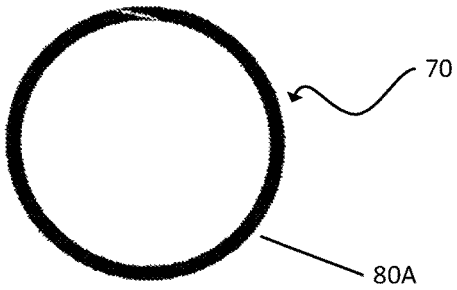
FIG. 4B

METHODS FOR PRESERVING ZONAL ISOLATION WITHIN A SUBTERRANEAN FORMATION

FIELD

The present disclosure relates to methods for mitigating flow of formation fluid between zones within a subterranean formation.

BACKGROUND

In preparation for production of a subterranean formation, a wellbore is drilled, penetrating the subterranean formation. In order to stabilize the wellbore, a casing is run into the wellbore. Generally, for effecting isolation or substantial isolation, of one or more zones of the subterranean formation from formation fluid being produced from another zone of the subterranean formation, zonal isolation material, such as cement, is provided within the wellbore, between casing and the subterranean formation.

Due to a number of reasons, zonal isolation may not be achieved. Less than desirable zonal isolation may result from improper setting of zonal isolation material (for example, cement) within the wellbore, shrinkage of the zonal isolation material as it sets up, fluid migration into the annulus before the zonal isolation material has set up, water escaping from the zonal isolation material as it is setting up, and the presence of remaining drilling mud within the annulus. As well, once the zonal isolation material has been set within the wellbore, the zonal isolation material may be subjected to a variety of mechanical and thermal stresses that may lead fractures, cracks, and/or debonding of the zonal isolation material from the casing and/or the subterranean formation. Such failure, manifested in the formation of channels and microannuli, may lead to loss of zonal isolation, resulting, for example, in the undesirable migration of formation fluids between zones within the subterranean formation. This may lead to lost production, costly remedial operations, environmental pollution, hazardous rig operations and/or hazardous production operations. Compromised sealant (cement) may render the wells unsuitable for storing crude oil or natural gas, injecting water or gas for pressure maintenance and enhanced recovery. Compromised sealant (cement) in the casing by the wellbore annulus also renders wells unsuitable for disposing of waste water or gases such as hydrogen sulphide and carbon dioxide, therefore rendering these wells unsuitable for carbon sequestration.

Existing attempts to mitigate failure to achieve zonal isolation relate to improving the characteristics of the zonal isolation material such that the zonal isolation material maintains its integrity even when subjected to the various mechanical and thermal stresses. As well, sealants, containing particles, e.g., cement, have been developed for injection into narrow pathways to remediate the created channels and micro-annuli. Neither of these solutions have been completely adequate. For example, in some cases, the narrow pathways present excessive resistance to flow of an injected sealant, while still permitting flow of a formation fluid (such as a gas) that is sufficiently compressible and has sufficiently low viscosity.

SUMMARY

In one aspect, there is provided a method for effecting at least partial interference of a fluid passage extending between a casing, disposed within a wellbore that is penetrating a subterranean formation, wherein zonal isolation material is disposed between the casing and the subterranean formation. The method includes, in response to detecting of the fluid passage, effecting an operative displacement of a casing section of the casing such that at least partial interference of the fluid passage is effected.

In some implementations, the operative displacement can effect at least partial occlusion of the fluid passage.

In some implementations, the effecting an operative displacement can include effecting deformation of the casing section.

In some implementations, the effecting an operative displacement can include effecting expansion of the casing section.

In some implementations, the effecting an operative displacement can include effecting expansion of a split-ring against the casing section. The effecting of the operative displacement can effect displacement of the casing section to a displaced position, and then, after the effecting of the operative displacement, the method can further include effecting retention of the casing section in the displaced position or in substantially the displaced position, wherein the effecting retention is effected by the expanded split-ring.

In some implementations, the effecting deformation can include effecting relative movement between a mandrel and a sleeve along their respective tapered surfaces such that deflection of the sleeve is effected in response to the relative movement and the deflected sleeve is pressed against the casing section for effecting the deformation. The effecting of the operative displacement can effect displacement of the casing section to a displaced position, and then, after the effecting of the operative displacement, the method can further include effecting retention of the casing section in the displaced position or in substantially the displaced position, wherein the effected retention is effected by the deflected sleeve.

In some implementations, the method can further include effecting opposition to an elastic contraction of the displaced casing section for mitigating reversion of the displaced casing section towards its original position prior to the operative displacement.

In some implementations, the effecting of the operative displacement can effect displacement of the casing section to a displaced position, and then, after the effecting of the operative displacement, the method can further include effecting retention of the casing section in the displaced position or in substantially the displaced position. Both of the effecting an operative displacement and the effecting retention can be effected by the same tool.

In some implementations, prior to the effecting an operative displacement of a casing section, the casing can be spaced-apart from the zonal isolation material to define a spacing, wherein the fluid passage is defined by the spacing. The operative displacement can be such that the casing section becomes disposed in a displaced position, and upon the casing section becoming disposed in the displaced position, the zonal isolation material is disposed opposite to a subterranean formation portion that is relatively impermeable.

In some implementations, prior to the effecting an operative displacement of a casing section, the zonal isolation material can be spaced-apart from the subterranean formation to define a spacing, wherein the fluid passage is defined by the spacing. The operative displacement can be such that the casing section becomes disposed in a displaced position, and upon the casing section becoming disposed in the displaced position, the zonal isolation material is disposed opposite to a subterranean formation portion that is relatively impermeable.

In some implementations, prior to the effecting an operative displacement, the casing section, to which a force is to be applied to effect the operative displacement, can be selected based on at least a determination that, upon the casing section becoming disposed in the displaced position, the zonal isolation material is disposed opposite to a subterranean formation portion that is relatively impermeable.

In some implementations, the at least partial interference can be effected over a continuous portion of the fluid passage having an axial length "L" of at least about five (5) centimeters.

In some implementations, prior to the effecting an operative displacement of a casing section of the casing, the method can further include detecting the fluid passage. The detecting can be effected by a zonal isolation material bond log or a zonal isolation material evaluation tool.

In another aspect, there is provided a method for effecting at least partial interference of a fluid passage extending between a casing, disposed within a wellbore that is penetrating a subterranean formation, wherein zonal isolation material is disposed between the casing and the subterranean formation. The method includes deploying a tool within the wellbore, and effecting an operative displacement of a casing section of the casing with the tool such that at least partial interference of the fluid passage is effected.

In some implementations, the effecting of the operative displacement can include exerting a force, with the tool, against the casing section.

In some implementations, the operative displacement can effect at least partial occlusion of the fluid passage.

In some implementations, the effecting an operative displacement can include effecting deformation of the casing section.

In some implementations, the effecting an operative displacement can include effecting expansion of the casing section.

In some implementations, the tool includes a split-ring, and the effecting an operative displacement can include effecting expansion of the split-ring against the casing section The effecting of the operative displacement can effect displacement of the casing section to a displaced position, and then, after the effecting of the operative displacement, the method can further includes effecting retention of the casing section in the displaced position or in substantially the displaced position, wherein the effecting retention is effected by the expanded split-ring.

In some implementations, the tool includes a mandrel and a sleeve, and the effecting deformation can include effecting relative movement between the mandrel and the sleeve along their respective tapered surfaces such that deflection of the sleeve is effected in response to the relative movement and the deflected sleeve is pressed against the casing section for effecting the deformation. The effecting of the operative displacement can effect displacement of the casing section to a displaced position, and then, after the effecting of the operative displacement, the method can further include effecting retention of the casing section in the displaced position or in substantially the displaced position, wherein the effected retention is effected by the deflected sleeve.

In some implementations, the method can further include effecting opposition to an elastic contraction of the displaced casing section for mitigating reversion of the displaced casing section towards its original position prior to the operative displacement.

In some implementations, the effecting of the operative displacement can effect displacement of the casing section to a displaced position, and then, after the effecting of the operative displacement, the method can further include effecting retention of the casing section in the displaced position or in substantially the displaced position. Both of the effecting an operative displacement and the effecting retention is effected by the tool.

In some implementations, prior to the effecting an operative displacement of a casing section, the casing can be spaced-apart from the zonal isolation material to define a spacing, wherein the fluid passage is defined by the spacing. The operative displacement can be such that the casing section becomes disposed in a displaced position, and upon the casing section becoming disposed in the displaced position, the zonal isolation material is disposed opposite to a subterranean formation portion that is relatively impermeable.

In some implementations, prior to the effecting an operative displacement of a casing section, the zonal isolation material can be spaced-apart from the subterranean formation to define a spacing, wherein the fluid passage is defined by the spacing. The operative displacement can be such that the casing section becomes disposed in a displaced position, and upon the casing section becoming disposed in the displaced position, the zonal isolation material is disposed opposite to a subterranean formation portion that is relatively impermeable.

In some implementations, prior to the effecting an operative displacement, the casing section, to which a force is to be applied to effect the operative displacement, can be selected based on at least a determination that, upon the casing section becoming disposed in the displaced position, the zonal isolation material is disposed opposite to a subterranean formation portion that is relatively impermeable.

In some implementations, the at least partial interference is effected over a continuous portion of the fluid passage having an axial length "L" of at least about five (5) centimeters.

In some implementations, the method further includes, prior to the effecting an operative displacement of a casing section of the casing, detecting the fluid passage. The detecting can be effected by a zonal isolation material bond log or a zonal isolation material evaluation tool.

In yet another aspect, there is provided a method for effecting at least partial interference of a fluid passage extending between a casing and a subterranean formation, the casing being disposed within a wellbore that is penetrating a subterranean formation, wherein cement is disposed between the casing and the subterranean formation. The method includes deploying a tool including a split ring within the wellbore, expanding the split ring against a casing section to effect an operative displacement of the casing section to a displaced position, wherein, upon the casing section becoming displaced to the displaced position, the cement becomes disposed opposite to a subterranean formation portion that is relatively impermeable and effects the at least partial interference of the fluid passage, and effecting retention of the casing section in the displaced position, or in substantially the displaced position, with the expanded split ring.

In yet another aspect, there is provided a method for effecting at least partial interference of a fluid passage extending between a casing and a subterranean formation, the casing being disposed within a wellbore that is penetrating a subterranean formation, and wherein cement is disposed between the casing and the subterranean formation.

The method including deploying a tool including a sleeve and a mandrel, wherein the sleeve is configured to be deflected in response to relative movement between a mandrel and the sleeve along their respective tapered surfaces, actuating relative movement between the mandrel and the sleeve along their respective tapered surfaces such that the sleeve is deflected and the deflected sleeve is pressed against the casing section such that an operative displacement of the casing section is effected, wherein, upon the casing section becoming displaced to the displaced position, the cement becomes disposed opposite to a subterranean formation portion that is relatively impermeable and effects the at least partial interference of the fluid passage, and effecting retention of the casing section in the displaced position, or in substantially the displaced position, with the deflected sleeve.

BRIEF DESCRIPTION OF DRAWINGS

The embodiments will now be described with the following accompanying drawings, in which:

FIG. 3A is a schematic illustration of an embodiment of an expansion/retainer tool, having a split ring with a v-notch, for use in practising the method of the present disclosure, illustrated in the unactuated condition;

FIG. 3B is a schematic illustration of the expansion/retainer tool of FIG. 3A, illustrated in the actuated or expanded condition;

FIG. 4A is a schematic illustration of an embodiment of an expansion/retainer tool, having a split ring with a saw-tooth ratchet, for use in practising the method of the present disclosure, illustrated in the unactuated condition;

FIG. 4B is a schematic illustration of the expansion/retainer tool of FIG. 4A, illustrated in the actuated or expanded condition;

DETAILED DESCRIPTION

Figure 1A:
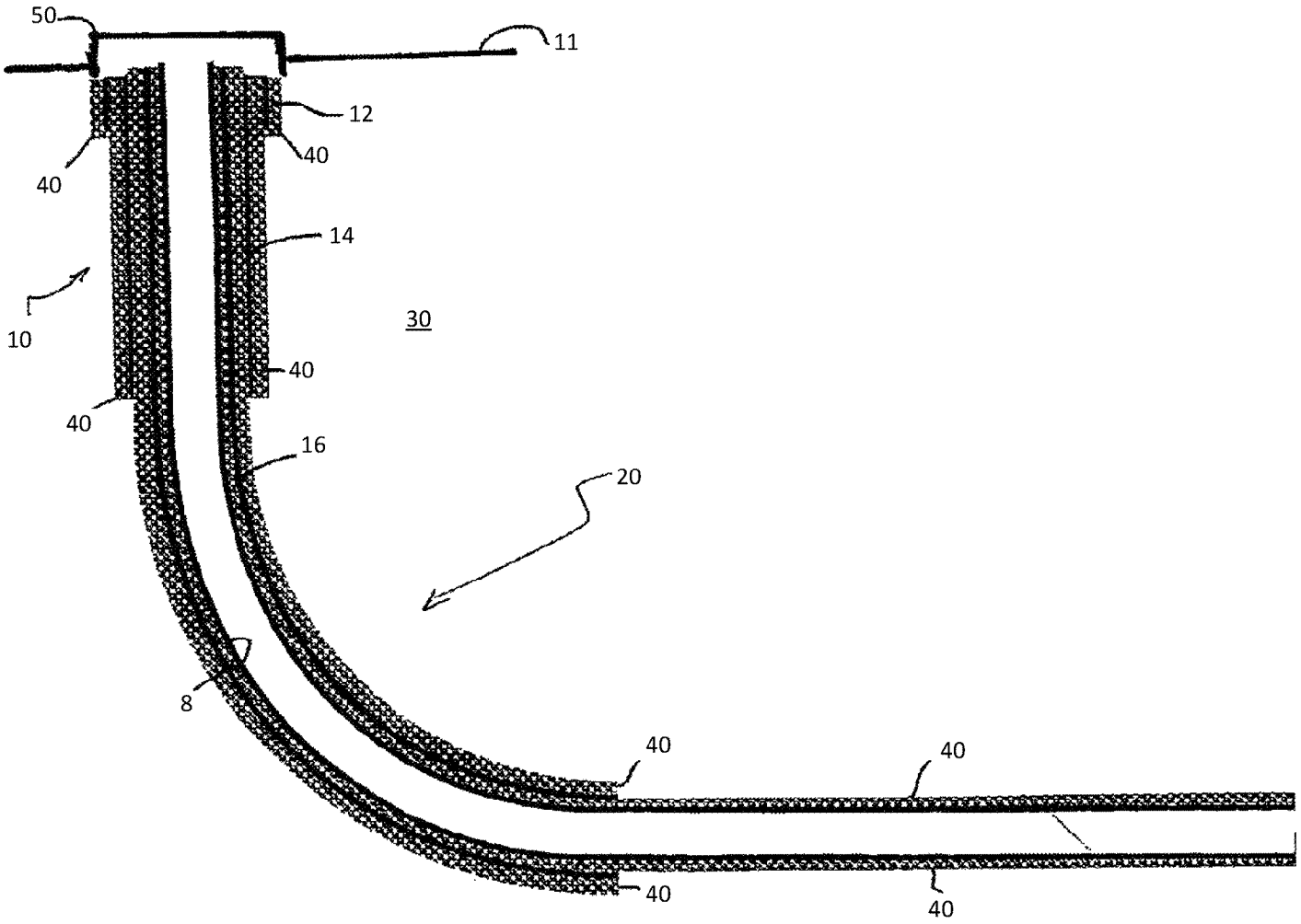
FIG. 1A is a schematic illustration of a horizontal well, with all casings cemented, and suitable for practising the method of the present disclosure.

There is provided a method for effecting at least partial interference of a fluid passage extending between a casing 10, disposed within a wellbore 20 that is penetrating a subterranean formation 30, and the subterranean formation. A zonal isolation material 40 is disposed within the wellbore 20, between the casing 10 and the subterranean formation 30.

Well completion is the process of preparing the well for injection of fluids into the subterranean formation 30, or for production of formation fluids from the subterranean formation 30. This may involve the provision of a variety of components and systems to facilitate the injection and/or production of fluids, including components or systems to segregate subterranean formation zones along sections of the wellbore 20. "Formation fluid" is fluid that is contained within a subterranean formation 30. Formation fluid may be liquid material, gaseous material, or a mixture of liquid material and gaseous material. In some embodiments, for example, the formation fluid includes water and hydrocarbonaceous material, such as oil, natural gas, or combinations thereof.

Fluids may be injected into the subterranean formation 30 through the wellbore 20 to effect stimulation of the formation fluids. For example, such fluid injection is effected during hydraulic fracturing, water flooding, water disposal, gas floods, gas disposal (including carbon dioxide sequestration), steam-assisted gravity drainage ("SAGD") or cyclic steam stimulation ("CSS"). In some embodiments, for example, the same wellbore 20 is utilized for both stimulation and production operations, such as for hydraulically fractured formations or for formations subjected to CSS. In some embodiments, for example, different wellbores 20 are used, such as for formations subjected to SAGD, or formations subjected to waterflooding.

The wellbore 20 may be completed either as a cased-hole completion or an open-hole completion.

Referring to FIG. 1A, a cased-hole completion involves running casing 10 down into the wellbore 20 through the production zone. The casing 10 at least contributes to the stabilization of the subterranean formation 30 after the wellbore 20 has been completed, by at least contributing to the prevention of the collapse of the subterranean formation 30 that is defining the wellbore 20.

The annular region between the deployed casing 10 and the subterranean formation 30 may be filled with zonal isolation material 40 for effecting zonal isolation (see below). The zonal isolation material 40 is disposed between the casing 10 and the subterranean formation (that defines the wellbore) for the purpose of effecting isolation, or substantial isolation, of one or more zones of the subterranean formation 30 from fluids disposed in another zone of the subterranean formation. Such fluids include formation fluid being produced from another zone of the subterranean formation 30 (in some embodiments, for example, such formation fluid being flowed through a production string disposed within and extending through the casing 10 to the surface), or injected fluids such as water, gas (including carbon dioxide), or stimulations fluids such as fracturing fluid or acid. In this respect, in some embodiments, for example, the zonal isolation material 40 is provided for effecting sealing, or substantial sealing, of fluid communication between one or more zones of the subterranean formation 30 and one or more others zones of the subterranean formation 30 (for example, such as a zone that is being produced). By effecting the sealing, or substantial sealing, of such fluid communication, isolation, or substantial isolation, of one or more zones of the subterranean formation 30, from another subterranean zone (such as a producing formation), is achieved. Such isolation or substantial isolation is desirable, for example, for mitigating contamination of a water table within the subterranean formation by the formation fluids (e.g. oil, gas, salt water, or combinations thereof) being produced, or the above-described injected fluids. Fluid communication between the wellbore and the formation is effected by perforating the production casing 10.

In some embodiments, for example, the zonal isolation material 40 is disposed as a sheath within an annular region between the casing 10 and the subterranean formation 30. In some embodiments, for example, the zonal isolation 40 material is bonded to both of the casing 10 and the subterranean formation 30.

In some embodiments, for example, the zonal isolation material 40 also provides one or more of the following functions: (a) strengthens and reinforces the structural integrity of the wellbore, (b) prevents, or substantially prevents, produced formation fluids of one zone from being diluted by water from other zones. (c) mitigates corrosion of the casing, and (d) at least contributes to the support of the casing.

The zonal isolation material 40 is introduced to an annular region between the production casing 10 and the subterranean formation 30 after the subject production casing 10 has been run into the wellbore 20. In some embodiments, for example, the zonal isolation material 40 includes cement.

Where the zonal isolation material 40 includes cement, such operation is known as "cementing". For illustrative purposes, the zonal isolation material is referred to below as cement, however, it should be understood that other material can be used as the zonal isolation material.

In some embodiments, for example, the casing 10 includes one or more casing strings, each of which is positioned within the well bore, having one end extending from the well head 50. In some embodiments, for example, each casing string is defined by jointed segments of pipe. The jointed segments of pipe typically have threaded connections.

Referring to FIGS. 1A to 1D, typically, a wellbore 20 contains multiple intervals of concentric casing strings, successively deployed within the previously run casing. With the exception of a liner string, casing strings typically run back up to the surface 11.

In the example well shown, the first casing string that is deployed is the conductor casing 12, which is cemented in place. The conductor casing 12 serves as a support during drilling operations, as a route for the drilling mud returns, and to prevent collapse of the loose soil near the surface. The next casing string is the surface casing 14, which is cemented in place. The primary purpose of the surface casing 14 is to isolate freshwater zones so that they are not contaminated during drilling and completion. A secondary purpose of the surface casing is to contain wellbore pressure and drilling or formation fluids should high pressures be encountered. Blowout preventers (BOPS) are attached to the surface casing before drilling recommences. Referring to FIG. 1A, an intermediate casing 16 may be deployed within the surface casing 14, and may be necessary on longer drilling intervals, or where it is necessary to use high density drilling mud weight to prevent blowouts. The production casing 8 is usually the last casing to be cemented in place. In some embodiments, for example, the wellbore is drilled to total measured depth ("TMD") without first installing an intermediate casing 16, and then the production casing 8 is run to TMD and cemented in place. This is sometimes called a monobore well design.

For wells that are used for producing formation fluids, few of these actually produce through production casing 8. This is because producing fluids can corrode steel or form undesirable deposits (for example, scales, asphaltenes or paraffin waxes) and the larger diameter can make flow unstable. In this respect, production tubing is usually installed inside the last casing string, and the annular region between the last casing string and the production tubing may be sealed at the bottom by a packer. The production tubing is provided to conduct produced formation fluids to the wellhead 50.

Figure 1B:
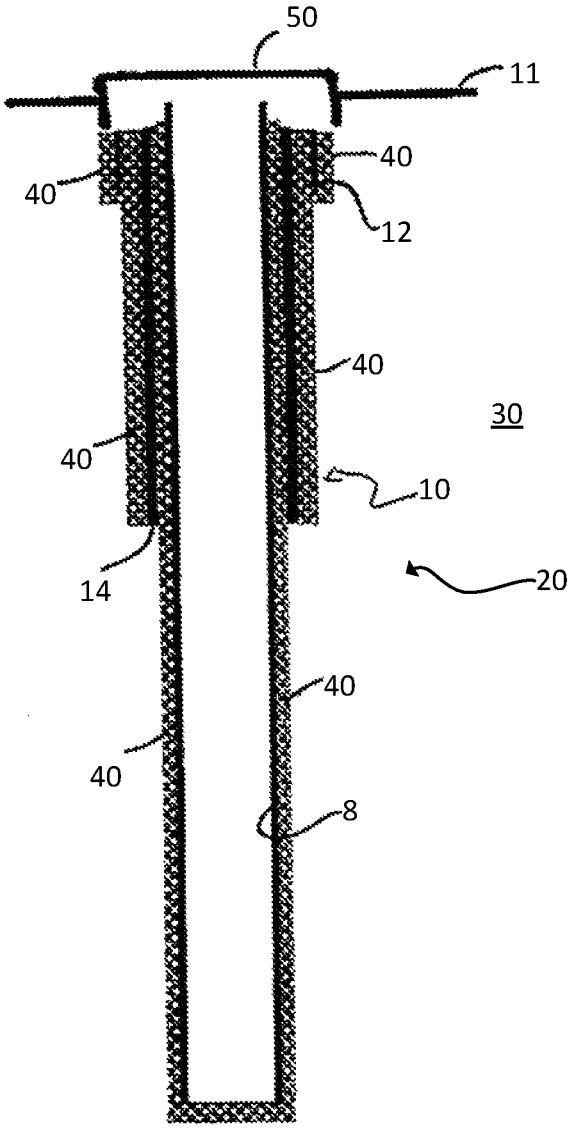
FIG. 1B is a schematic illustration of a vertical well, with cemented production casing, without a production string/tubular, and suitable for practising the method of the present disclosure
Figure 1C:
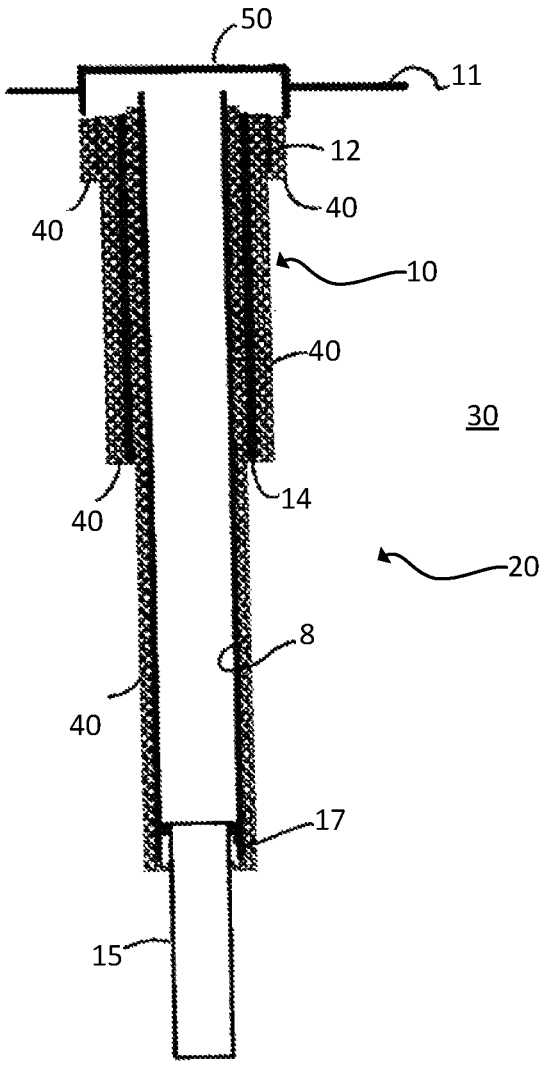
FIG. 1C is a schematic illustration of a vertical well, with a liner positioned along a production zone, and suitable for practising the method of the present disclosure
Figure 1D:
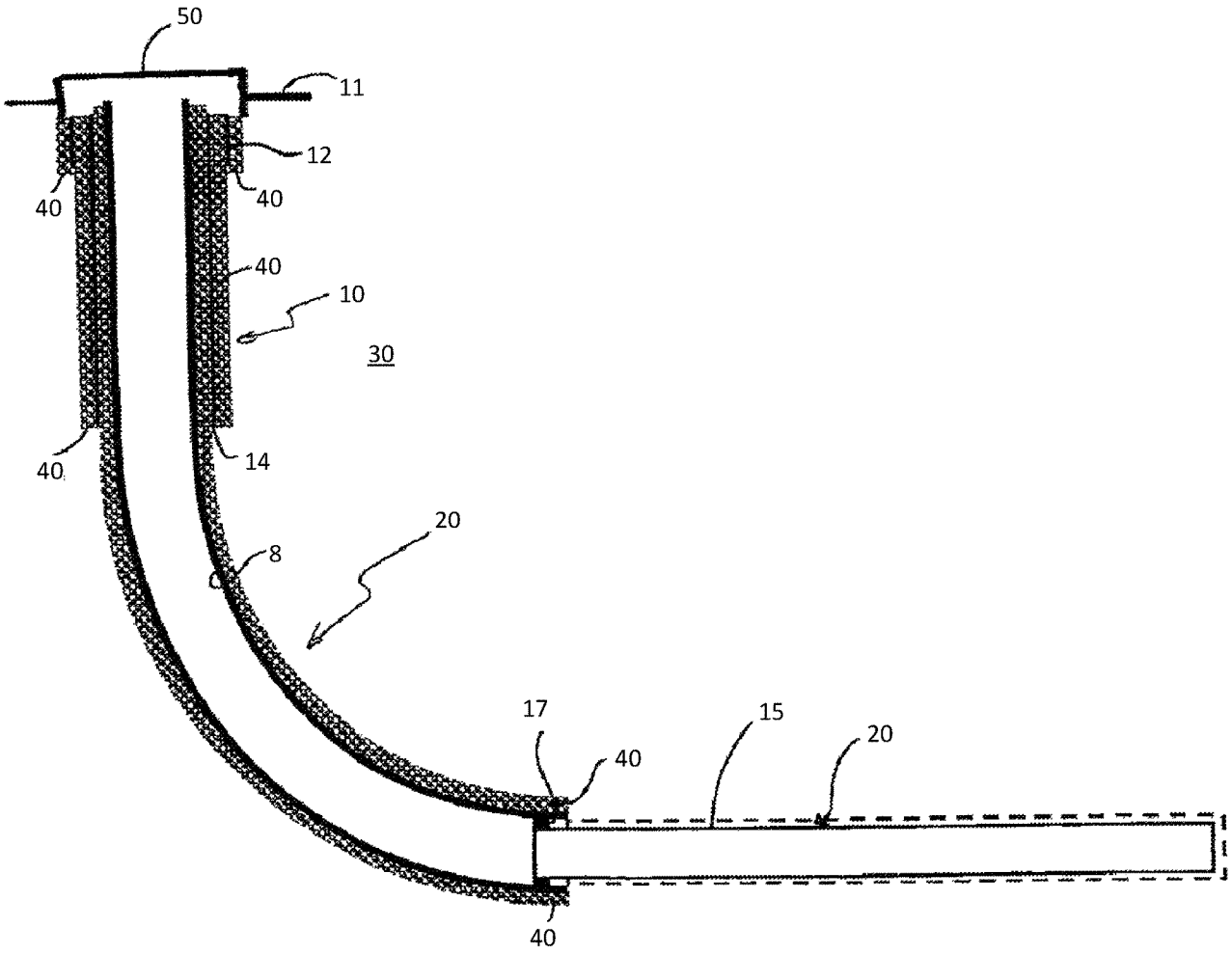
FIG. 1D is a schematic illustration of a horizontal well, with a liner positioned along a production zone, without a production string/tubular, and suitable for practising the method of the present disclosure.

Referring to FIGS. 1C and 1D, in some embodiments, for example, the production casing 8 is set short of total depth. Hanging off from the bottom of the production casing 8, with a liner hanger or packer 17, is a liner string 15. The liner string 15 can be made from the same material as the casing string, but, unlike the casing string, the liner string 15 does not extend back to the wellhead. Zonal isolation material 40 may be provided within the annular region between the liner string 15 and the subterranean formation for effecting zonal isolation (see below), but is not in all cases. The liner string 15 can also be slotted or perforated. The production tubular may be stung into the liner string 15, thereby providing a fluid passage for conducting the produced formation fluids to the wellhead 50. In some embodiments, for example, no cemented liner is installed, and this is called an open hole completion.

Referring to FIG. 1B, vertical cased hole completions typically have ±13 m of conductor pipe and surface casing to ±¼ of the true vertical depth (TVD). BOPs are attached to the surface casing before drilling recommences. Once at total depth (TD), which may also be called TMD, the production casing 8 is run and cemented in place. Referring to FIG. 1C, deeper horizons may require setting the production casing 8 short of TD and hanging off a cemented liner 15 from the bottom of the production casing 8 with a liner hanger 17.

Referring to FIG. 1D, horizontal cased hole completions typically have ±13 m of conductor pipe 12, surface casing 14 to +¼ of the true vertical depth (TVD) and production casing 8 to the end of the build section. The horizontal section is drilled to TMD and a liner 15 is cemented in place. In some embodiments, for example, this liner is perforated to access the reservoir. In some embodiments, for example, the liner 15 is a screen or is slotted. In some embodiments, for example, no cemented liner 15 is installed, and this is referred to as an open hole completion.

An open-hole completion is effected by drilling down to the top of the producing formation, and then casing the wellbore. The wellbore 20 is then drilled through the producing formation, and the bottom of the wellbore is left open (i.e. uncased). Open-hole completion techniques include bare foot completions, pre-drilled and pre-slotted liners, and open-hole sand control techniques such as stand-alone screens, open hole gravel packs and open hole expandable screens.

Figure 2:
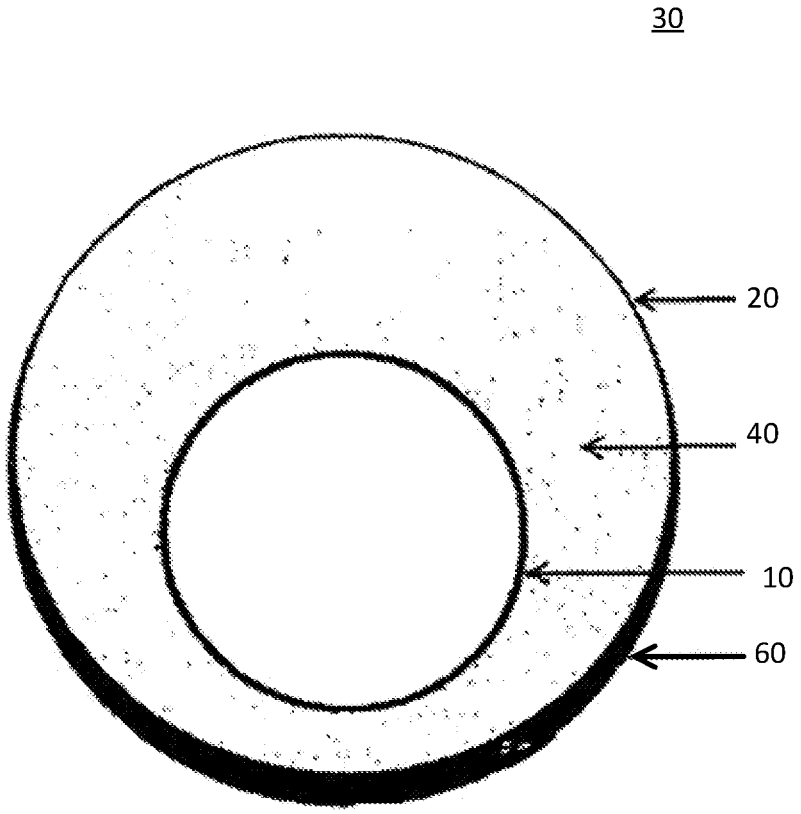
FIG. 2 is an axial view taken along a cross-section of the well of FIG. 1, illustrating a condition of inadequate zonal isolation within the wellbore.

In some cases, zonal isolation within the wellbore 20 may not be adequately realized. Failure to realize the zonal isolation may occur from the outset, prior to well production. For example, if the casing is improperly centralized, drilling fluid, used during drilling of the wellbore 20, may not be adequately displaced by the zonal isolation material 40 as the zonal isolation material 40 is being introduced to space within the wellbore 20 between the production casing 10 and the subterranean formation 30. Failure to adequately displace the drilling fluid may result in the formation of a channel in a section of the wellbore (see FIG. 2). As yet a further example, a small gap can form between the production casing 10 and the zonal isolation material 40, resulting from variations in temperature or pressure, during or after zonal isolation material introduction process (for example, the cementing process), which cause shrinkage of the zonal isolation material 40 as the zonal isolation material 40 hardens (for example, most cements shrink somewhat (2 to 4%) as they set up or harden).

Also, the zonal isolation may become compromised after commissioning, especially with thermal wells, such as those being produced by CSS or steam flooding (such as SAGD). This may be due to thermal expansion and/or pressure expansion.

When CSS wells are in their injection cycle, the production casing 10 expands and pushes against the subterranean formation with significant force. This can displace softer sedimentary rock, and effect application of tensile forces on the zonal isolation material 40 (e.g. cement), which may cause the zonal isolation material 40 to crack. When CSS wells are in the production phase, the casing experiences less internal pressures, and becomes cooler. This combination of reduced pressure and thermal contraction tends to result in contraction of the casing to a smaller diameter, resulting in a micro-annulus at the interface between the zonal isolation material 40 and the subterranean formation 30.

Steam flood wells, including SAGD injectors and producers, will also expand due to temperature and internal pressure. At the end of life of a steam flood project, it is common practice to inject non-corrosive gas to capture heat that resides within the steam chamber, thereby extending the life of the project (such as for 1 to 2 years) without the expense of generating steam. At this point in the life of the well, the casing and the zonal isolation material 40 (e.g. cement) will cool and contract, leaving a microannulus. It is therefore possible that gases (including injected gases or naturally occurring gases) might migrate upwards on the outside of the production casing 16 and/or the surface casing 14 towards the ground surface 11.

It is therefore desirable to effect at least partial interference with, or at least partially occlude, a fluid passage 60 that has become disposed within the wellbore 20, between casing 10 and the subterranean formation 30. The fluid passage 60 can be a channel, micro-annulus, or otherwise.

In order to effect this, sensing for a presence of such fluid passage 60 is effected. Such sensing may be effected prior to (such as after well completion), during, or after production (such as during workovers). Gas escaping from a well is usually detected at a Surface Casing Vent Flow (SCVF) assembly on the wellhead. The SCVF channels gases in the production by surface casing annulus to a stand pipe. One can measure the gas flow rate at the stand pipe, plus sample the gas to determine composition.

In some embodiments, for example, once the escaping gas is detected, detection of the spatial disposition of the fluid passage is effected by cement bond logs or cement evaluation tools. Cement bond logs (CBLs) are run in most wells. Cement evaluation tools (CETs) are improved CBLs that can map the cement on the outside of the casing, which helps identify channels in the cement. If the CBL or CET senses a suspect cement sheath, then a pressure pass is run (typically at 7000 kPa internal casing pressure). If the cement map improves, then the well probably has a micro-annulus and a cement squeeze will not be done due to the low probability of success. If the cement map does not improve, then the well probably has a channel and a cement squeeze may be attempted—especially if an escaping gas is detected at a SCVF assembly.

Figure 7A:
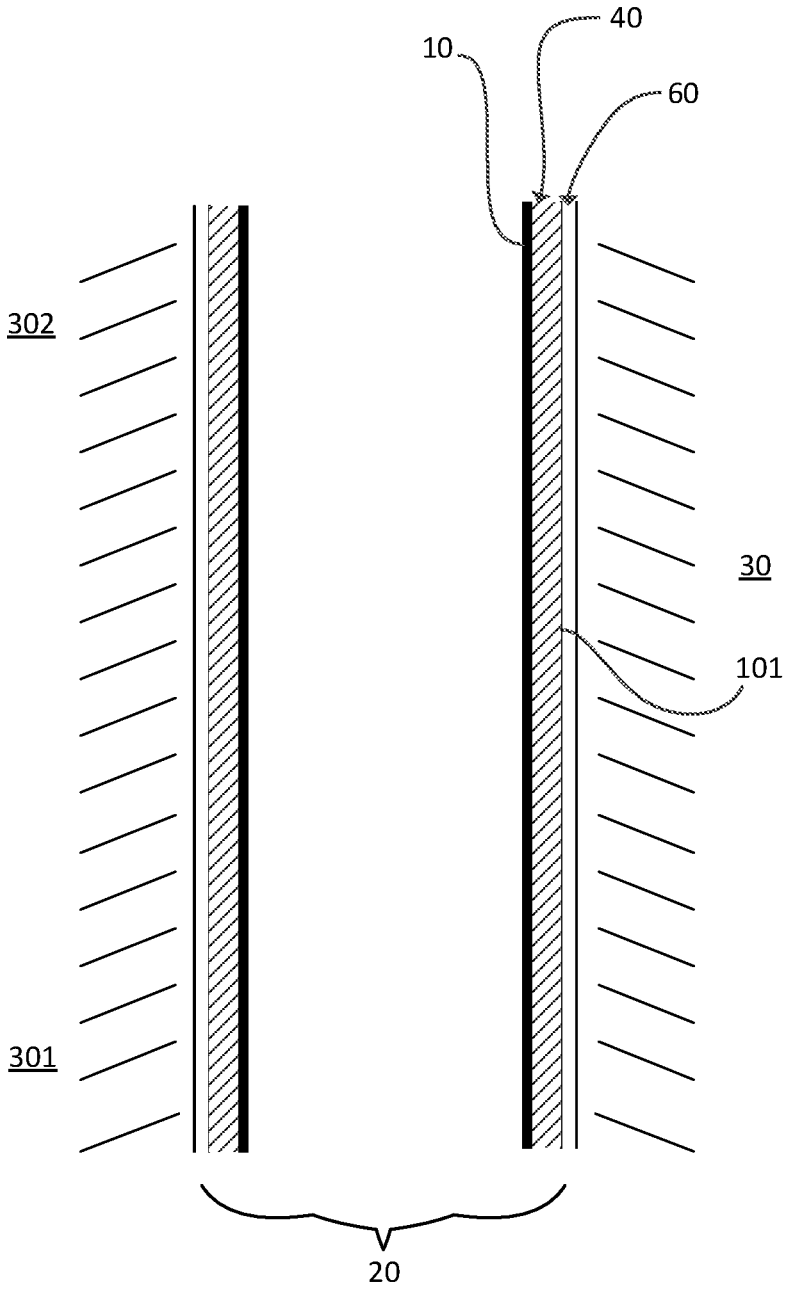
FIG. 7A is a schematic illustration of a casing section disposed within a wellbore, with a fluid passage being defined within the wellbore effecting fluid communication between zones of a subterranean formation.
Figure 7B:
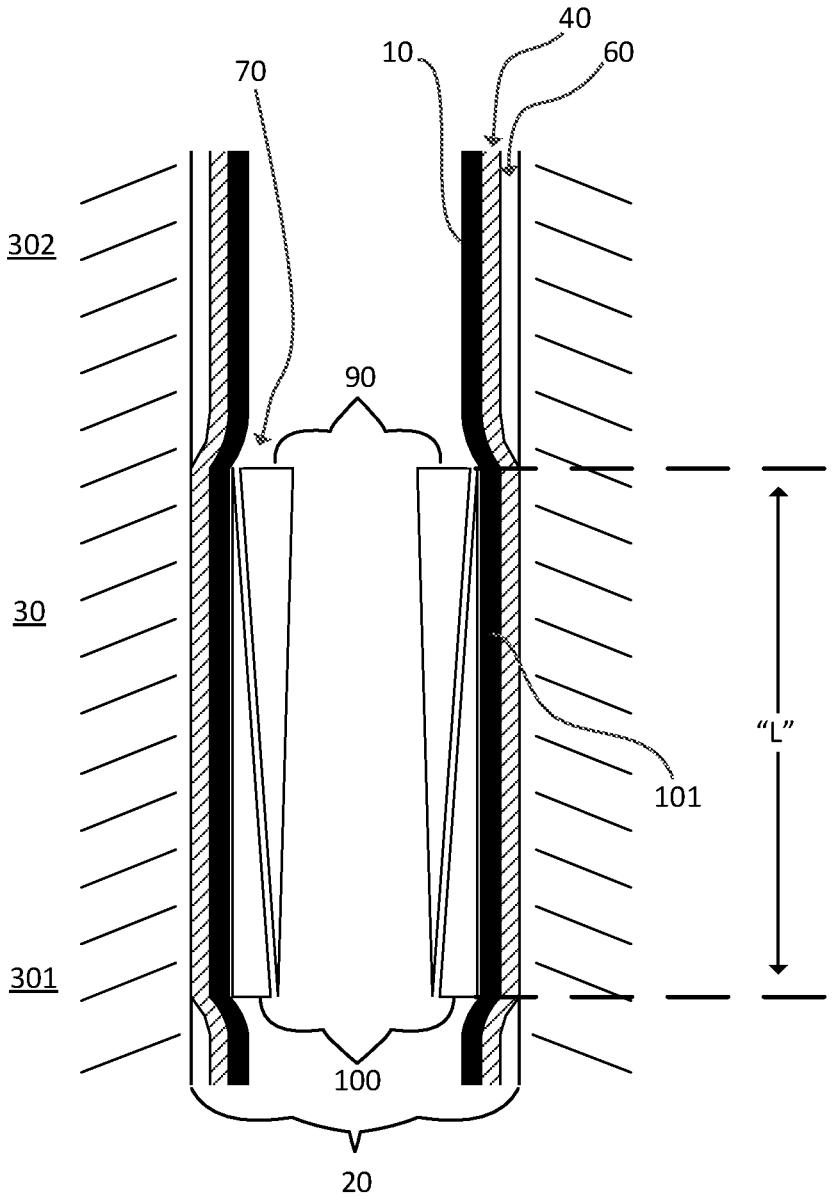
FIG. 7B is a schematic illustration of the casing section in FIG. 7B after displacement/deformation by an expansion/retainer tool.

Referring to FIGS. 7A and 7B, after the presence of a fluid passage 60 is detected, in one aspect, an operative displacement of a casing section 101 of the casing 10 is effected, such that at least partial interference of the fluid passage 60 is effected.

In another aspect, and after the presence of a fluid passage 60 is detected, deformation of a casing section 101 is effected. In some embodiments, for example, the deformation effects displacement of the casing section 101 such that a displaced casing section 101 results from the deformation.

In some embodiments, for example, the effecting of the operative displacement, or of the deformation, includes effecting expansion of the casing section 101. In some of these embodiments, the effecting of the operative displacement, or of the deformation, is effected by an expansion tool 70. In some embodiments, for example, the effected expansion of the casing section 101 will effect enlargement of the wellbore because the subterranean formation is generally weaker than the pressure exerted by effecting expansion of the casing section 101. If the pressure being applied to the casing section 101 is released, and depending on the nature of the materials of the casing section 101, the casing section 101 may elastically contract, effecting at least partial reformation of the fluid passage 60. In order to at least partially maintain the effected interference, opposition to this contraction of the casing section 101 is provided.

Figure 8:
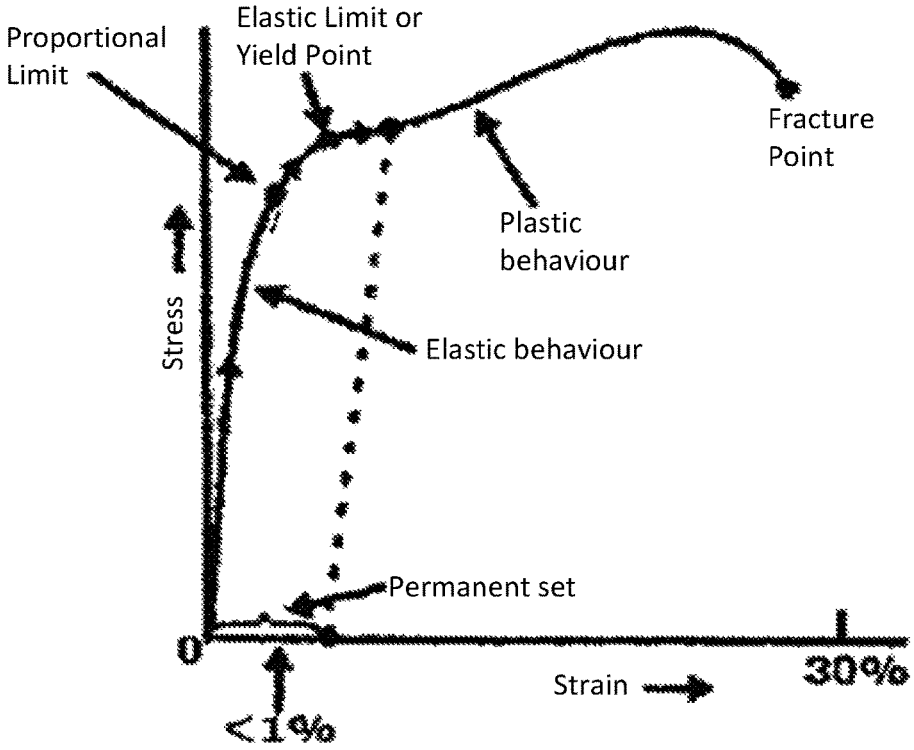
FIG. 8 is a graphical illustration of a typical stress-strain curve for a material.

In this respect, in some embodiments, for example, the method further comprises effecting opposition to an elastic contraction of the displaced casing section (or the deformed casing section, as the case may be). Elastic contraction of the displaced casing section (or the deformed casing section, as the case may be), towards its original position prior to the operative displacement (or the deformation), may reverse the effects of the original displacement, and result in at least partial re-establishment of the fluid passage 60. A typical stress-strain curve is illustrated in FIG. 8. After becoming deformed in response to an applied stress, materials generally, have a tendency to return to their original shape, so long as the applied stress is below the elastic limit. If the applied stress is above the elastic limit, the resultant deformation is such that elasticity is lost.

In a similar respect, in some embodiments, for example, the effecting of the operative displacement effects displacement of the casing section 101 to a displaced position, and, after the effecting of the operative displacement, the casing section 101 is retained in the displaced position, or in substantially the displaced position. "Retained in substantially the displaced position" means that that the effected disposition of the casing section 101 is such that the interference effected by the operative displacement continues to be at least partially maintained.

In a further similar respect, in some embodiments, for example, the effecting of the deformation, effects disposition of the casing section 101 to a deformation-effected position, and, after the effecting of the deformation, the casing section 101 is retained in the deformation-effected position, or in substantially the deformation-effected position. "Retained in substantially the deformation-effected position" means that the effected disposition of the casing section 101 is such that the interference effected by the deformation continues to be at least partially maintained.

In some embodiments, for example, the retention is effected by a retainer tool. In some embodiments, for example, the expansion tool 70 and the retainer tool are the same tool.

In some of these embodiments, for example, and referring to FIGS. 3A and 4A, the expansion/retainer tool 70 includes a split ring 80, and the effecting operative displacement, or deformation, includes effecting expansion of the split-ring 80 (see FIGS. 3B and 4B) against the casing section 101. In the embodiment illustrated in FIGS. 3A and 3B, the split ring 80 is in the form of a split ring with a v-notch 80A. In the embodiment illustrated in FIGS. 4A and 4B, the split ring 80 is in the form of a split ring with a sawtooth ratchet 80B. In some embodiments, for example, the effected expansion of the split ring 80 is hydraulically or mechanically actuated. In some of these embodiments, the expansion tool 70 is disposed on a downhole tool assembly. The downhole tool assembly may be delivered downhole along the wellbore from a surface location via a suitable conveyance. Examples of a suitable conveyance include production tubing, coiled tubing, cable, wireline, or slickline.

In some embodiments, for example, the expansion/retainer tool would be run in hole with the split ring 70 on the outside of an inflatable packer. The packer would expand the split ring 70 to the inside diameter of the casing section 101 that is to be expanded. The split-ring 70 would then be further expanded against the casing with a casing roller. The split ring 70 should offer very little resistance, so the casing roller should be able to expand the casing. Once expanded, the sawtooth ratchet, or the v-notch, on the split ring 70, as the case may be, would hold the casing in the expanded state. Examples of suitable rollers include a Weatherford MetalSkin Roller™ or a Logan Casing Roller™.

In those embodiments where the effected expansion of the casing section 101 effects enlargement of the wellbore owing to the fact that the subterranean formation is generally weaker than the pressure exerted by effecting expansion of the casing section 101, the split ring 70, in the expanded condition, exerts sufficient force against the casing section 101 such that the casing section 101 is retained in the displaced position or in substantially the displaced position, or, in the situation where the casing section 101 has been previously deformed to effect the at least partial interference, the exerted force by the split ring 70 is sufficient so that the casing section 101 is retained in the deformation-effected position or in substantially the deformation-effected position.

Figures 5A, 5B:
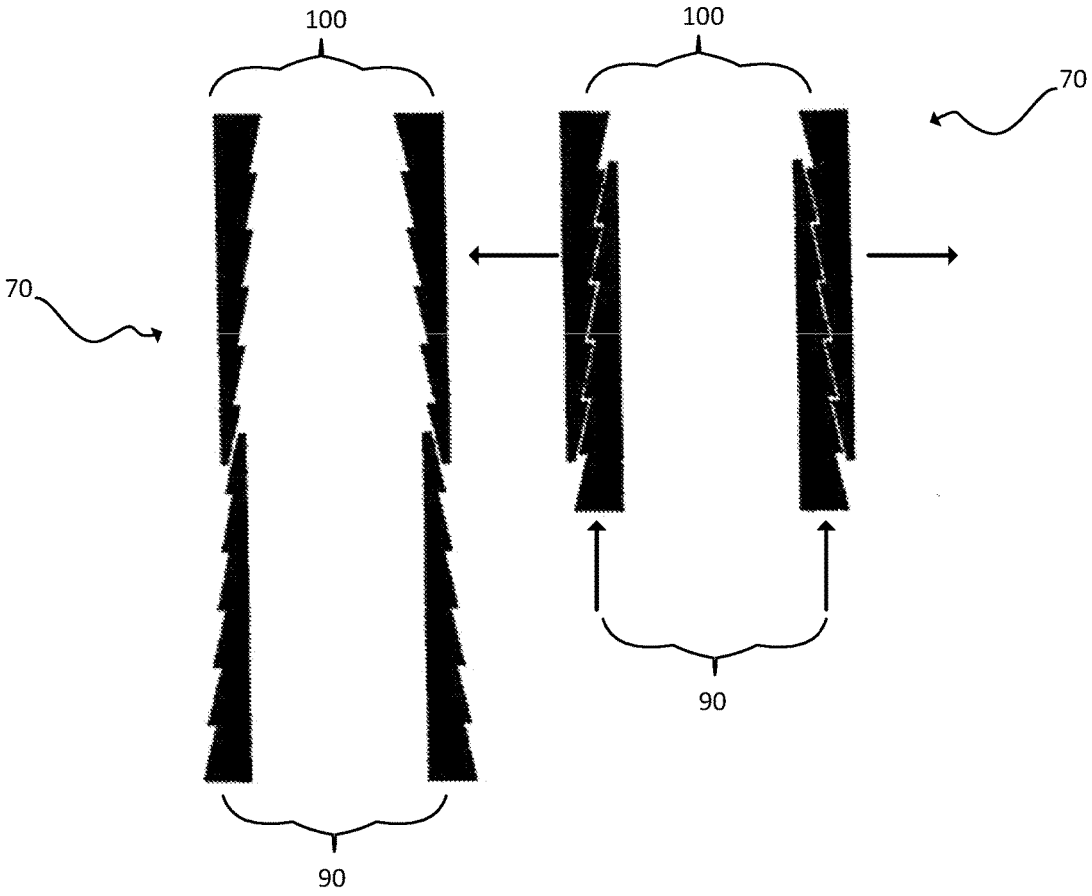
FIG. 5A is a schematic illustration of an embodiment of an expansion/retainer tool, having a tapered mandrel and sleeve of the ratchet style, for use in practising the method of the present disclosure, illustrated in the unactuated condition.
FIG. 5B is a schematic illustration of the expansion/retainer tool of FIG. 5A, illustrated in the actuated or expanded condition.
Figure 6B:
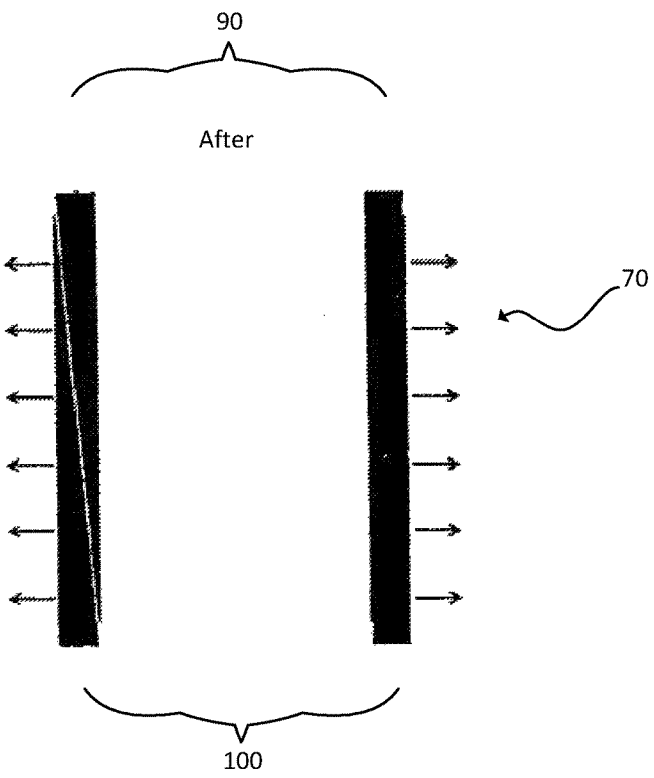
FIG. 6B is a schematic illustration of the expansion/retainer tool of FIG. 6A, illustrated in the actuated or expanded condition.
Figure 6A:
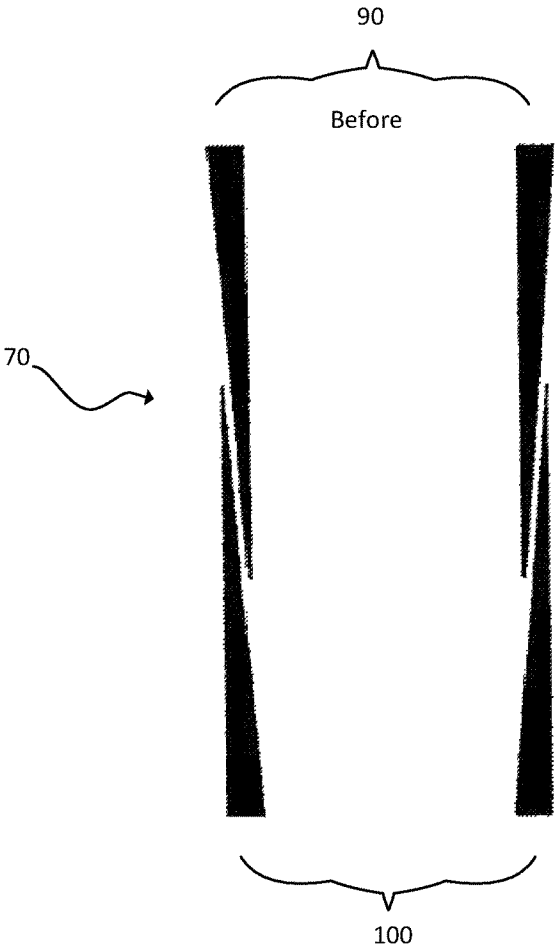
FIG. 6A is a schematic illustration of an embodiment of an expansion/retainer tool, having a tapered mandrel and sleeve of the Morse Taper (or Machine Taper) style, for use in practising the method of the present disclosure, illustrated in the unactuated condition.

In some of these embodiments, for example, and referring to FIGS. 5A and 6A, the expansion/retainer tool 70 includes a tapered mandrel 90 and a tapered sleeve 100. The tapered mandrel 90 and the tapered sleeve 100 are co-operatively configured such that actuation (for example, hydraulically or mechanically) of the tapered mandrel 90 effects deflection of the tapered sleeve 100 (see FIGS. 5B and 6B), thereby effecting pressing of the tapered sleeve 100 against the production casing 10, and thereby effecting the operative displacement, or the deformation of the production casing 10, as the case may be. In the illustrated embodiment, in effecting the deflection of the tapered sleeve 100, the tapered mandrel 90 is moved axially relative to the sleeve 100 (in an upwardly direction in the FIG. 5B embodiment, and in a downwardly direction in the FIG. 5B embodiment), and the taper of the tapered mandrel 90 is forced along the opposing taper of the inside surface of the tapered sleeve 100, and this causes the sleeve 100 to expand radially outwards, engaging the casing section 101 and effecting its expansion. In the embodiment illustrated in FIGS. 5A and 5B, the tapered mandrel 90 and the tapered sleeve 100 are of the ratchet-type. In the embodiment illustrated in FIGS. 6A and 6B, the tapered mandrel 90 and the tapered sleeve 100 are configured in the form of a Morse-style taper. In some of these embodiments, this expansion/retaining tool 70 is disposed on a downhole tool assembly. The downhole tool assembly may be delivered downhole along the wellbore from a surface location via a suitable conveyance. Examples of a suitable conveyance include production tubing, coiled tubing, cable, wireline, or slickline. Examples of a suitable tools for effecting setting of this expansion tool include a Halliburton Fas-N-EZ™ hydraulic setting tool, a Schlumberger CPST Pressure Setting Tool™, or a Baker Setting Tool™.

In some embodiments, for example, the assembly of the tapered mandrel 90 and the tapered sleeve 100 may be locked into place relative to the casing section 100 prior to setting. In some embodiments, for example, the assembly may be latched into a gap in the threaded connection. Such gaps at connections are typically found in casing with the following threaded and coupled casing connections: i) Short Thread and Coupled (STC), ii) Long Thread and Coupled (LTC) and iii) Buttress connections. Upward or downward force could then be applied to force the mandrel into the taper. Downward force could be applied weight, while upward force could be applied tension. Downward force could be applied with a machine, such as a downhole hammer or bumper tool, while upward force could be applied using a jarring tool.

In those embodiments where the effected expansion of the casing section 101 effects enlargement of the wellbore owing to the fact that the subterranean formation is generally weaker than the pressure exerted by effecting expansion of the casing section 101, the tapered sleeve 100, in the expanded condition, exerts sufficient force against the casing section 101 such that the casing section 101 is retained in the displaced position or in substantially the displaced position, or, in the situation where the casing section 101 has been previously deformed to effect the at least partial interference, the exerted force by the tapered sleeve 100 is sufficient so that the casing section 101 is retained in the deformation-effected position, or in substantially the deformation-effected position, by the tapered mandrel 90.

Referring to FIGS. 7A and 7B, a casing section 101 is illustrated, before (FIG. 7A) and after (7B) an expander tool 70 has been deployed to effect displacement/deformation of the casing section 101 such that the fluid passage 60 becomes occluded. The occlusion is such that fluid communication between zones 301 and 302, of the subterranean formation, becomes sealed or substantially sealed. FIG. 7A illustrates a fluid passage 60 defined within the wellbore 20, between the zonal isolation material 40 and the subterranean formation 30. FIG. 7B illustrates the displacement/deformation of the casing section 101, specifically by the expansion tool 70 illustrated in FIGS. 6A and 6B.

In some embodiments, for example, the operative displacement is such that the casing section 101 becomes disposed in a displaced position, and upon the casing section 101 becoming positioned in the displaced position, the zonal isolation material 40 is disposed opposite to a subterranean formation portion that is relatively impermeable. A relatively impermeable formation is a formation that has a permeability of less than 0.1 millidarcies. Suitable examples of relatively impermeable formations include shale or mud stone.

In some embodiments, for example, the operative displacement, or the deformation, effects at least partial occlusion of the fluid passage 60.

In some embodiments, for example, prior to the effecting of the operative displacement, or the deformation, the casing section 101 is selected based on at least a determination that the casing section 101 is displaceable, in response to application of a predetermined force, to a displaced position, such that the at least partial interference of the fluid passage 60 is effected upon the casing section 101 becoming positioned in the displaced position. In some of these embodiments, for example, the selecting is further based on a determination that, upon the casing section 101 becoming positioned in the displaced position, the zonal isolation material 40 is disposed opposite to a subterranean formation portion that is relatively impermeable.

In some embodiments, for example, the method further includes effecting opposition to reversion of the displaced casing section 101 towards its original position prior to the operative displacement. In some embodiments, for examples, the expansion tools 70, described above, and illustrated in FIGS. 3A, 3B, 4A, 4B, 5A, 5B, 6A, and 6B, when disposed in the expanded condition, provides the above-described opposition to the reversion of the displaced casing section 101 towards its original position prior to the operative displacement.

In some embodiments, for example, the casing is spaced-apart from the zonal isolation material 40 to define a spacing, and the fluid passage 60 is defined within the spacing. In some of these embodiments, for example, the fluid passage 60 is defined, in-part, by the casing 10.

In some embodiments, for example, the zonal isolation material 40 is spaced apart from the subterranean formation 30, and the fluid passage 60 is defined within the spacing. In some of these embodiments, for example, the zonal isolation material 40 is sealingly engaged, or substantially sealing engaged, to the casing 10. In some of these embodiments, for example, the zonal isolation material 40 is bonded to the casing 10. In some of these embodiments, for example, the fluid passage 60 is defined, in-part, by the zonal isolation material 40.

In some embodiments, for example, the at least partial interference is effected over a continuous portion of the fluid passage having an axial length of at least five (5) centimeters.

Reference throughout the specification to "one embodiment," "an embodiment," "some embodiments," "one aspect," "an aspect," or "some aspects" means that a particular feature, structure, method, or characteristic described in connection with the embodiment or aspect is included in at least one embodiment of the present invention. In this respect, the appearance of the phrases "in one embodiment" or "in an embodiment" or "in some embodiments" in various places throughout the specification are not necessarily all referring to the same embodiment. Furthermore, the particular features, structures, methods, or characteristics may be combined in any suitable manner in one or more embodiments.

Each numerical value should be read once as modified by the term "about" (unless already expressly so modified), and then read again as not so modified unless otherwise indicated in context. Also, in the summary and this detailed description, it should be understood that a concentration range listed or described as being useful, suitable, or the like, is intended that any and every concentration within the range, including the end points, is to be considered as having been stated. For example, "a range of from 1 to 10" is to be read as indicating each and every possible number along the continuum between about 1 and about 10. Thus, even if specific data points within the range, or even no data points within the range, are explicitly identified or refer to only a few specific data points, it is to be understood that inventors appreciate and understand that any and all data points within the range are to be considered to have been specified, and that inventors have disclosed and enabled the entire range and all points within the range.

In the above description, for purposes of explanation, numerous details are set forth in order to provide a thorough understanding of the present disclosure. However, it will be apparent to one skilled in the art that these specific details are not required in order to practice the present disclosure. Although certain dimensions and materials are described for implementing the disclosed example embodiments, other suitable dimensions and/or materials may be used within the scope of this disclosure. All such modifications and variations, including all suitable current and future changes in technology, are believed to be within the sphere and scope of the present disclosure. All references mentioned are hereby incorporated by reference in their entirety.

What is claimed is:

1. A method for effecting at least partial interference of a fluid passage extending between a subterranean formation and a casing disposed within an open-hole or cased-hole completed wellbore penetrating the subterranean formation, comprising:

after zonal isolation material disposed between the casing and the subterranean formation has set, and in response to detecting of the fluid passage, effecting an operative displacement of a section of the casing to a displaced position, wherein, upon the casing section becoming displaced, the zonal isolation material becomes disposed opposite to the subterranean formation and effects at least partial interference of the fluid passage; and effecting opposition to an elastic contraction of the displaced casing section for mitigating reversion of the displaced casing section towards its original position prior to the operative displacement, wherein the opposition to the elastic contraction of the displaced casing section is effected and maintained by a tool that is deployed and remains within the section of the casing.

2. The method as claimed in claim 1, wherein the effecting of the operative displacement includes effecting expansion of the casing section.

3. The method as claimed in claim 1, wherein the tool includes a mandrel and a sleeve, and the effecting of the operative displacement of the section of the casing includes effecting relative movement between the mandrel and the sleeve along their respective tapered surfaces such that deflection of the sleeve is effected in response to the relative movement and the deflected sleeve is pressed against the casing section to expand the casing section.

4. The method as claimed in claim 3, wherein the effecting of the opposition to the elastic contraction of the displaced casing section comprises maintaining the deflected sleeve within the expanded casing section.

5. The method as claimed in claim 1, wherein both of the effecting of the operative displacement and the effecting of the opposition to the elastic contraction are effected by the same tool.

6. The method as claimed in claim 1, wherein, prior to the effecting of the operative displacement of the casing section, the casing is spaced apart from the zonal isolation material to define a spacing, wherein the fluid passage is defined by the spacing.

7. The method as claimed in claim 1, wherein, prior to the effecting of the operative displacement of the casing section, the zonal isolation material is spaced apart from the subterranean formation to define a spacing, wherein the fluid passage is defined by the spacing.

8. The method as claimed in claim 1, further comprising, prior to the effecting of the operative displacement, selecting the casing section, to which a force is to be applied to effect the operative displacement, based on at least a determination that, upon the casing section becoming disposed in the displaced position, the fluid passage will become obstructed by the casing or by displaced zonal isolation material.

9. The method as claimed in claim 1, wherein the at least partial interference is effected over a continuous portion of the fluid passage having an axial length "L" of at least about five (5) centimeters.

10. The method as claimed in claim 1, further comprising:

prior to the effecting of the operative displacement of the section of the casing, detecting the fluid passage.

11. The method as claimed in claim 10, wherein the detecting is effected by a zonal isolation material bond log or a zonal isolation material evaluation tool.

12. The method as claimed in claim 1, wherein the operative displacement is effected by deploying the tool within the wellbore.

13. The method as claimed in claim 12, wherein the effecting of the operative displacement includes exerting a force, with the tool, against the casing section.

14. A method for effecting at least partial interference of a fluid passage extending between a subterranean formation and a casing disposed within an open-hole or cased-hole completed wellbore penetrating the subterranean formation, comprising:

deploying a tool within the wellbore after zonal isolation material disposed between the casing and the subterranean formation has set;

in response to detecting of the fluid passage, radially expanding the tool to effect an operative displacement of a section of the casing to a displaced position, wherein, upon the section of the casing becoming displaced, the zonal isolation material becomes disposed opposite to the subterranean formation and effects at least partial interference of the fluid passage extending between the casing and the subterranean formation; and effecting opposition to an elastic contraction of the displaced casing section for mitigating reversion of the displaced casing section towards its original position prior to the operative displacement, wherein the tool remains within the section of the casing to maintain the opposition to the elastic contraction of the displaced casing section.

15. The method as claimed in claim 14, wherein the effecting of the operative displacement comprises effecting deformation or expansion of the casing section.

16. The method as claimed in claim 15, wherein the tool includes a mandrel and a sleeve, and the effecting of the deformation or expansion includes effecting relative movement between the mandrel and the sleeve along their respective tapered surfaces such that deflection of the sleeve is effected in response to the relative movement and the deflected sleeve is pressed against the casing section for effecting the deformation or expansion of the casing section.

17. The method as claimed in claim 16, wherein the opposition to the elastic contraction of the displaced casing section is effected by maintaining the deflected sleeve within the casing.

18. A method for effecting at least partial interference of a fluid passage extending between a casing and a subterranean formation, wherein the casing is disposed within a wellbore that is penetrating a subterranean formation, and wherein cement is disposed between the casing and the subterranean formation, comprising:

deploying a tool including a split ring within the wellbore;

expanding the split ring against a casing section to effect an operative displacement of the casing section to a displaced position, wherein, upon the casing section becoming displaced to the displaced position, the cement becomes disposed opposite to a subterranean formation portion that is relatively impermeable and effects the at least partial interference of the fluid passage; and effecting retention of the casing section in the displaced position, or in substantially the displaced position, with the expanded split ring.

19. A method for effecting at least partial interference of a fluid passage extending between a subterranean formation and a casing disposed within an open-hole or cased-hole completed wellbore penetrating the subterranean formation, comprising:

after cement disposed between the casing and the subterranean formation has set, deploying within the wellbore a tool including a sleeve and a mandrel, wherein the sleeve is configured to be radially expanded in response to relative movement between the mandrel and the sleeve along their respective tapered surfaces; and in response to detecting of the fluid passage, actuating relative movement between the mandrel and the sleeve along their respective tapered surfaces such that the sleeve is radially expanded and the radially expanded sleeve is pressed against the casing section such that an operative displacement of the casing section is effected, wherein, upon the casing section becoming displaced to the displaced position, the cement becomes disposed between the casing and the subterranean formation and effects at least partial interference of the fluid passage, wherein the tool remains within the section of the casing to maintain the operative displacement of the casing section to the displaced position.

20. A method for occluding a gap between a casing of an open-hole or cased-hole completed wellbore and a formation, the method comprising:

after zonal isolation material disposed between the casing and the formation has set, identifying the presence of the gap between the casing's external surface and the formation;

deploying an expansion tool within the casing; and radially expanding the expansion tool to apply an outward force against the casing with the expansion tool, thereby expanding and operatively displacing the casing radially outwards to a displaced position, wherein, upon the casing becoming displaced, the zonal isolation material between the casing and the formation becomes disposed opposite to the formation and effects occlusion of the gap, wherein the expansion tool remains within the section of the casing to maintain the operative and radially outward displacement of the casing section to the displaced position.

21. The method as claimed in claim 20, wherein the gap is formed subsequent to operation of the wellbore to recover hydrocarbons from the formation.

22. The method as claimed in claim 20, wherein the gap allows gas, fluid, or vapor migration from the formation to the surface along the outside of the casing.

23. The method as claimed in claim 20, wherein the gap is situated within cement between the casing and the formation.

24. The method as claimed in claim 23, wherein the cement has lost structural integrity subsequent to thermal operation of the wellbore.

25. A method for restoring zonal isolation in a cased and cemented portion of a thermally operated and open-hole or cased-hole completed well in a formation, wherein zonal isolation material is disposed between the casing and the formation, the method comprising:

detecting the presence of a gap extending between the casing and the formation after the zonal isolation material has set;

deploying an expansion tool within a section of the casing; and radially expanding the expansion tool to effect an operative and radially outward displacement of the casing section to a displaced position, wherein, upon the casing section being displaced, the zonal isolation material becomes disposed opposite to the formation and effects occlusion of the gap, wherein the expansion tool remains within the section of the casing to maintain the operative and radially outward displacement of the casing section to the displaced position.

26. The method as claimed in claim 25, wherein the gap is formed subsequent to operation of the wellbore to recover hydrocarbons from the formation.

27. The method as claimed in claim 25, wherein the gap allows gas, fluid, or vapor migration from the formation to the surface along the outside of the casing.

28. The method as claimed in claim 25, wherein the expansion tool comprises a sleeve having tapered surfaces.

29. The method as claimed in claim 25, wherein the gap is situated within cement between the casing and the formation.

30. The method as claimed in claim 29, wherein the cement has lost structural integrity subsequent to thermal operation of the wellbore.

31. The method as claimed in claim 25, wherein the expansion tool has an opening such that fluid communication is permitted within the section of the casing.

* * * * *